US009228291B2

(12) United States Patent
Ahn et al.

(10) Patent No.: US 9,228,291 B2
(45) Date of Patent: Jan. 5, 2016

(54) DRYER

(75) Inventors: Seung-Phyo Ahn, Changwon-si (KR); Jeong-Yun Kim, Changwon-si (KR); Sang-Ik Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1206 days.

(21) Appl. No.: 13/131,771

(22) PCT Filed: Dec. 16, 2009

(86) PCT No.: PCT/KR2009/007527

§ 371 (c)(1),
(2), (4) Date: May 27, 2011

(87) PCT Pub. No.: WO2010/071354

PCT Pub. Date: Jun. 24, 2010

(65) Prior Publication Data

US 2011/0225838 A1 Sep. 22, 2011

(30) Foreign Application Priority Data

Dec. 17, 2008 (KR) ..... 10-2008-0128608

(51) Int. Cl.

| | |
|---|---|
| ***F26B 21/06*** | (2006.01) |
| ***D06F 58/04*** | (2006.01) |
| ***D06F 58/22*** | (2006.01) |

(52) U.S. Cl.
CPC ..... *D06F 58/04* (2013.01); *D06F 58/22* (2013.01)

(58) Field of Classification Search
CPC ..... D06F 58/04; D06F 58/22
USPC ..... 34/82, 85, 595, 601, 603
See application file for complete search history.

(56) References Cited

U.S. PATENT DOCUMENTS

| | | | | |
|---|---|---|---|---|
| 3,034,226 | A * | 5/1962 | Conlee | 34/596 |
| 7,305,775 | B2 | 12/2007 | Favret | |
| 2007/0107250 | A1 * | 5/2007 | Gassmann et al. | 34/82 |

FOREIGN PATENT DOCUMENTS

| | | | |
|---|---|---|---|
| DE | 8224528 | | 2/1983 |
| GB | 2360471 | A * | 9/2001 |
| JP | 06-098993 | | 4/1994 |
| JP | 07-000694 | A | 1/1995 |
| JP | 2001-276494 | A | 10/2001 |
| JP | 2002-200395 | A | 7/2002 |
| KR | 10-2004-0056809 | A | 7/2004 |
| WO | WO 01/96647 | | 12/2001 |

* cited by examiner

*Primary Examiner* — Jiping Lu
(74) *Attorney, Agent, or Firm* — Dentons US LLP

(57) ABSTRACT

Provided is a dryer. In the dryer, foreign substances such naps generated during a drying process are filtered by a filter unit, and the foreign substances attached to the filter unit are automatically removed.

10 Claims, 5 Drawing Sheets

DRYER

This application is a National Stage Entry of International Application No. PCT/KR2009/007527, filed Dec. 16, 2009, which claims the benefit of Korean Patent Application No. 10-2008-0128608, filed on Dec. 17, 2008, all of the applications are hereby incorporated by reference for all purposes as if fully set forth herein.

TECHNICAL FIELD

The present disclosure relates to a dryer and a method of removing foreign substances in the dryer.

BACKGROUND ART

Generally, dryers are devices that a hot wind generated by a heater blows into a rotary drum to absorb moisture of an object (e.g., washed clothes) to be dried (hereinafter, referred to as a "dry object"), thereby drying the dry object.

Such a dryer is classified into a vented dryer and a condenser dryer according to a method of drying the dry object. In detail, the vented dryer uses a method in which moist air exhausted from a drum is exhausted to the outside of the dryer. The condenser dryer uses a recycling method in which moist air exhausted from a drum is condensed in a heat-exchanger to remove moisture, and then, the dry air is heated again to return to the drum.

Since the drum is a rotary type, the dry object received into the drum is shaken within the drum due to the rotation of the drum. In this process, foreign substances contained in the dry object are spread into the air. That is, the foreign substances are contained in the air passing through the drum.

The foreign substances contained in the air may pass through the mechanical components of the dryer to cause a break down of the components. In addition, the foreign substances may be discharged to the outside of the dryer to harm user's health. Thus, the air passing through the dryer should pass through a filter to remove the foreign substances.

Generally, the filter is disposed at a front side of the drum to filter the foreign substances contained in the air passing through the drum. When the foreign substances are gathered over a predetermined level on the filter, filter cleaning is required because airflow interferes. Generally, the filter is detachably coupled to the dryer. After a drying process is finished, a user separates the filter from the dryer to clean the filter.

Particularly, since the foreign substances were contained in moist air and hold moisture, the foreign substances adhere to the filter with sweat. As the drying process is progressed, an amount of moisture contained in the air gradually decreases. As a result, the moist foreign substances are dried, and therefore, the dried foreign substances adhere to the filter. Thus, there is a limitation that user takes the trouble to neatly clean the filter because the user are strongly shaking out the foreign substances.

If the filter is left in a state in which the foreign substances adhere thereto, since adequate wind quantity is not secured, the dryer may be overheated to cause a fire.

Thus, it is a troublesome that the filter cleaning should be more frequently performed to secure wind quantity and prevent a fire from occurring.

DISCLOSURE OF INVENTION

Technical Problem

Embodiments provide a dryer in which a filter is automatically cleaned to allow a user to dump only foreign substances separated from the filter and a method of removing the foreign substances in the dryer.

Embodiments also provide a dryer in which an amount of wind passing through a filter is maintained over a predetermined level to improve drying performance, and risk of fire is significantly reduced and a method of removing the foreign substances in the dryer.

Solution to Problem

In one embodiment, a dryer includes: a cabinet defining an outer appearance; a drum inside the cabinet, the drum receiving a dry object; a drum cover supporting a front surface of the drum; a base supporting the drum cover, the base having an air passage in which moist air passing through the drum flows; and a filter unit within the drum cover, the filter unit filtering foreign substances contained in the moist air passing through the drum, wherein the filter unit comprises: a filter part to which the foreign substances contained in the moist air are attached; and a brush unit separating the foreign substances attached to the filter part.

In another embodiment, a dryer includes: a cabinet defining an outer appearance; a drum inside the cabinet; a drum cover supporting a front surface of the drum, the drum cover comprising a throwing hole through which a dry object is thrown and an air duct extending downwardly form the throwing hole; a filter unit filtering foreign substances contained in moist air exhausted from the drum, at least a portion of the filter unit inserted into the air duct; a housing connected to a lower end of the air duct; and a base disposed below the drum, the base having an air passage in which the moist air passing through the drum flows.

Advantageous Effects of Invention

According to the dryer and the method of removing the foreign substances in the dryer, the foreign substances adhering to the filter can be automatically to improve convenience of use.

Also, it may be not required to clean the filter whenever the dryer is utilized. This is done because only the lint case is separated to dump the foreign substances. Therefore, the convenience of use may be maximized.

Also, in case where the filter is automatically cleaned, since an amount of wind passing through the inside of the drum may be maintained over a predetermined level, risk of fire may be significantly reduced.

MODE FOR THE INVENTION

Reference will now be made in detail to the embodiments of the present disclosure, examples of which are illustrated in the accompanying drawings.

Figure 1:
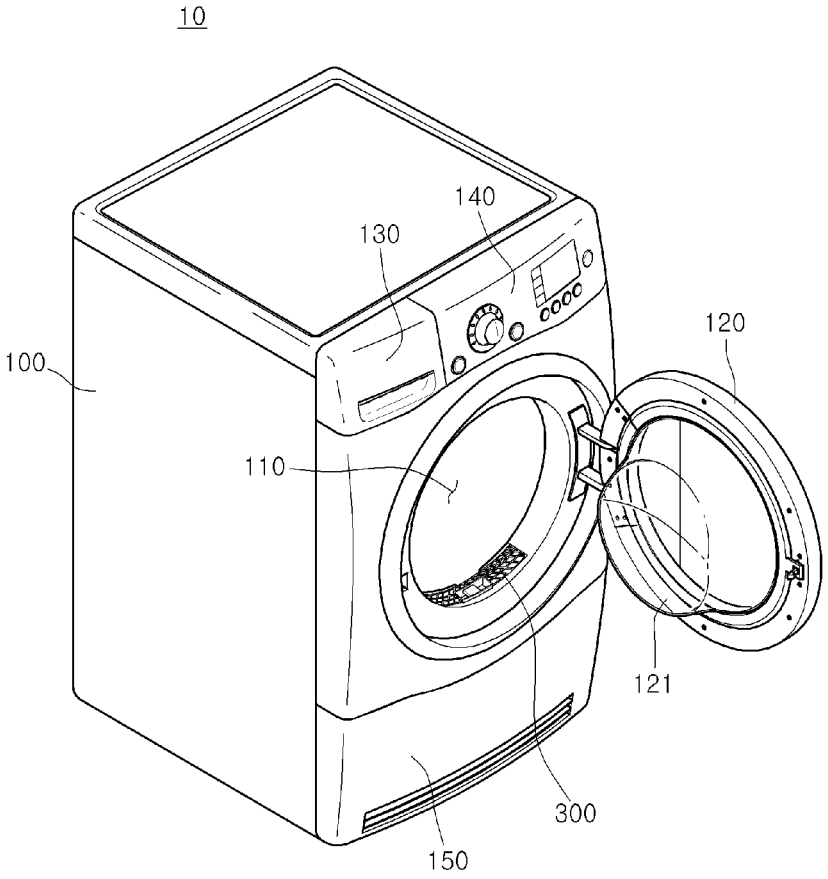
FIG. 1 is a perspective view illustrating an outer appearance of a dryer according to an embodiment.

FIG. 1 is a perspective view illustrating an outer appearance of a dryer according to an embodiment.

Hereinafter, for describing the spirit of the present disclosure, a condenser dryer will be described as an example. However, the spirit of the present disclosure is not limited to the condenser dryer, but is applicable to a vented dryer.

Referring to FIG. 1, a dryer 10 according to an embodiment includes a cabinet 100 defining an outer appearance and having an opening 110 in a front surface of a door 120 rotatably coupled to a side of the cabinet 100 and selectively covering the opening 110.

A drum (see reference numeral 200 of FIG. 2) for receiving dry objects such as clothes thrown through the opening 110 of the cabinet 100 is disposed inside the cabinet 100. Here, the dry objects contain a large amount of moisture.

A transparent window 121 may be disposed on a door 120 to confirm a dry condition by viewing the inside of the drum (see reference numeral 200 of FIG. 2) even through the door 120 is closed.

An operation part 140 is disposed on a side of the cabinet 100 to operate a drying cycle. A display and a plurality of buttons are disposed on the operation part 140 to allow a user to perform a desired drying cycle.

A drawer 130 is disposed in a front surface of the cabinet 110 to discharge condensed water generated during the drying process of the dry objects. Also, a lower cover 150 is detachably disposed on a lower portion of the front surface of the cabinet 100. The lower cover 150 prevents a heat exchanger (see reference numeral 260 of FIG. 2) for cooling air circulating the inside of the dryer 10 from being viewed from the outside. The user may separate the lower cover 150 from the cabinet 100, and then withdraw the heat exchanger 260 to clean heat exchanger 260.

A filter unit 300 is disposed at a front side of the drum 200 to remove the foreign substances contained in the air passing through the drum 200. Hereinafter, specific descriptions related to an operation of the filter unit 300 will be described.

Figure 2:
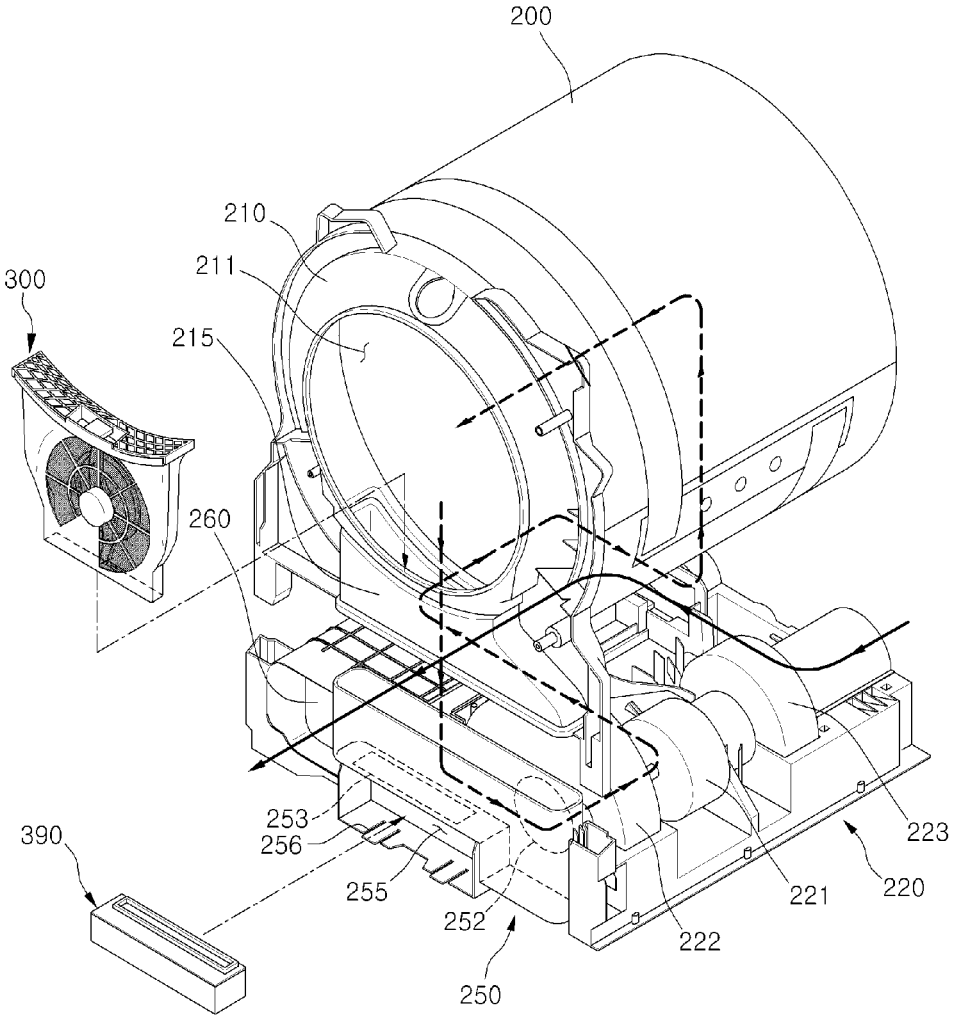
FIG. 2 is a perspective view illustrating main internal components of a dryer according to an embodiment.

FIG. 2 is a perspective view illustrating main internal components of a dryer according to an embodiment.

Referring to FIG. 2, the cabinet 100 includes the drum 200, a drum cover 210, a driving motor 221, and a base 220. The dry objects are received into the drum 200 and dried. The drum cover 210 is coupled to a front surface of the drum 200 to support the drum 200. The driving motor 221 is disposed below the drum 200 to rotate the drum 200. A blow fan 222 connected to the driving motor 221 to blow air into the drum 220 is disposed on the base 220.

In detail, the drum 200 has a cylindrical shape with opened front and rear surfaces. The front surface of the drum 200 is disposed toward the opening 110. Also, the front surface of the drum 200 is rotatably coupled to the drum cover 210. A felt may be disposed on the drum cover 210 contacting the drum 200 to smoothly rotate the drum 200.

The drum cover 210 supports the drum 200 and is coupled and installed to a front end of the base 220. A throwing hole 211 through which the dry objects are thrown is defined in the drum cover 210. Here, a portion of the drum cover 210 corresponding to the opening 110 and the front surface of the drum 200 is punched to define the throwing hole 211. That is, when the user opens the door 120 and then puts the dry objects through the opening 110, the dry objects pass through the throwing hole 211 and are received into the drum 200.

Also, an air duct 215 is disposed at a lower side of the throwing hole 211 to circulate the air passing through the drum 200. The air duct 215 has opened lower and upper sides through which the air passes. The lower side of the air duct 215 is connected to a housing (that will be described later) 250 disposed on the base 220. The filter unit 300 is disposed in the air duct 215 to filter the foreign substances. The operation of the filter unit 300 will be described later.

The base 220 defines a bottom surface of the dryer 10 and supports the drum cover 210 and the drum 200. In detail, the driving motor 221 for rotating the drum 200 is disposed on the base 220. The driving motor 221 is disposed at an approximately central portion of the base 220. The driving motor 221 is connected to the drum 200 using a belt (not shown) to rotate the drum 200.

The blow fan 222 for blowing the air into the drum 200 is disposed on the base 220. The blow fan 222 is connected to the driving motor 221 and rotated by the driving motor 221. The blow fan 222 is disposed forward the driving motor 221.

A cooling fan 223 connected to the driving motor 221 and rotated by the driving motor 221 to suck external air is disposed backward the driving motor 221. The external air sucked by the cooling fan 223 absorbs heat while passing through the heat exchanger 260.

A heater (not shown) for heating the air introduced into the drum 200 is disposed backward the drum 200.

The heat exchanger 260 is disposed at a side of the base 220 to heat-exchange between the circulation air discharged from the drum 200 and the air introduced from the outside of the dryer 10. The heat exchanger 260 is disposed withdrawable from a front side of the base 220. The user may withdraw the heat exchanger 260 to clean the heat exchanger 260. A specific operation of the heat exchanger 260 will be described later.

The housing 250 is detachably disposed on a front side of the base 220. The housing 250 is vertically disposed below the drum cover 210 and connected to a lower end of the air duct 215.

In detail, the housing 250 has an approximately rectangular parallelepiped shape. A depressed insertion groove 251 in which the filter unit 300 is inserted is defined in an upper end of the housing 250. The insertion groove 251 is connected to the lower end of the air duct 215. Thus, when the filter unit 300 is inserted into the air doctor 215, a portion of the filter unit 300 is received into the insertion groove 251.

The insertion groove 251 extends up to a front side of the blow fan 222. A communication hole 252 is defined at a position corresponding to a suction part of the blow fan 222. Thus, the air passing through the filter unit 300 is sucked into the blow fan 222 through the communication hole 252.

A lint case receiving part 255 to which a lint case 390 is detachably coupled is disposed below the housing 250. In detail, the lint case receiving part 255 may be disposed in the front surface of the base 220. A portion of the base 220 may be depressed to have a shape corresponding to that of the lint case, or a rib having a shape surrounding the lint case 390 may protrude from the front surface of the base 220 to form the lint case receiving part 255. A hook 256 may be disposed on a bottom surface of the lint case receiving part 255 to prevent the lint case 390 from being easily separated after the lint case 390 is coupled to the lint case receiving part 255. The lint case 390 has a basket shape with opened upper surface and is installed at the lint case receiving part 255.

A foreign substance dropping hole 253 is defined in a bottom surface of the housing 250 corresponding to a bottom surface of the filter unit 300 to receive the dropping foreign substances into the lint case 390. In detail, a foreign substance discharge hole is defined in the bottom surface of the filter unit 300, and the foreign substance dropping hole is disposed corresponding to the foreign substance discharge hole. Thus, the foreign substances separated from the filter unit 300 pass through the foreign substance discharge hole and the foreign substance dropping hole 253 and drop into the lint case 390. When the foreign substances stored in the lint case 390 exceed a predetermined level, the user may separate the lint case 390 to dump the foreign substances.

A portion of the filter unit 300 may protrude toward the inside of the foreign substance dropping hole 253. In this case, an inlet of the lint case 390 may be directly connected to the foreign substance discharge hole to securely prevent the foreign substances from leaking to the outside.

The housing 250 may cover portions of an inlet and outlet of the heat exchanger 260 to secure a size of the filter part 330 that will be described later. In this case, the lower cover may be firstly removed, and the housing 250 may be removed, and then, the heat exchanger 260 may be withdrawn.

Since the dry objects contain a large amount of moisture, the moisture contained in the dry objects is evaporated while the dry hot wind passes through the dry objects. This process is performed at the same time when the drum 200 is rotated. That is, the dry objects are dried while they are rotated together with the drum 200. At this time, the foreign substances such as dusts and naps contained in the dry objects are spread into the moist air within the drum 200. That is, the foreign substances are contained in the moist air passing through the drum 200. When the foreign substances are introduced into the blow fan 222, the blow fan 222 may be broken down. Thus, the foreign substances should be filtered before they pass through the blow fan 222.

Thus, the filter unit 300 is disposed in the drum cover 210 to filter the foreign substances contained in the air passing through the drum 200. In detail, the filter unit 300 is inserted downwardly from an upper side of the air duct 215. Also, a portion of the filter unit 300 is inserted into the insertion groove 251 of the housing 250.

At this time, air is introduced from an upper side of the filter unit 300, and the air in which the foreign substances are filtered is exhausted in a rear direction of the filter unit 300. Thus, a front surface of the filter unit 300 may be spaced from the air duct 215 and a front surface of the housing 250 such that the air smoothly flows inside the drum cover 210 and the insertion groove 251. That is, the filter unit 300 may have a thickness in a front-rear direction less than those of the air duct 215 and the insertion groove 251.

Also, the filter unit 300 has a shape corresponding to that of the inlet (upper end) of the air duct 215 to prevent the foreign substances contained in the moist air from building up the neighborhood of the inlet of the air duct 215. That is, in a state where the filter unit 300 is inserted into the air duct 215, a top surface of the filter unit 300 has the same surface as a duct cover of the inlet of the air duct 215.

Hereinafter, airflow of the dryer 10 including the above-described components will be simply described.

The dryer 10 is a condenser dryer. Thus, air circulating inside the dryer 10 (see a dotted arrow of FIG. 2, and hereinafter, referred to as a circulation air) is cooled by air introduced from the outside of the dryer 10 (see a straight arrow of FIG. 2, and hereinafter, referred to as a cooling air).

In detail, with respect to the drum 200, the circulation air within the drum 200 includes a large amount of foreign substances containing moisture. The circulation air forwardly flows by the rotation of the blow fan 222. That is, the blow fan 222 generates a suction flow to suck the circulation air toward the blow fan 222. The circulation air exhausted from the drum 200 passes through the filter unit 300 disposed in the air duct 215. In this process, the foreign substances are filtered by the filter part 330 that will be described later.

The circulation air passing through the filter unit 300 flows toward the heat exchanger 260 through the blow fan 222. Then, the circulation air heat-exchanges with the cooling air in the heat exchanger 260 and thus is cooled. At this time, since the circulation air contains moisture, condensed water is generated when the circulation air is cooled. The condensed water flows toward the drawer 130 and then is discharged. Here, the condensed water generated in the heat exchanger 260 may flow toward a separate condensed water storage part (not shown) disposed at a side of the base 220, and a pump (not shown) may be disposed in the condensed water storage part. A condensing hose (not shown) may extend from the pump and be connected to a back surface of the drawer 130. Thus, the condensed water generated in the heat exchanger 260 flows toward the drawer 130 and then is stored in the drawer 130. Thereafter, the user may separate the drawer 130 to dump the stored condensed water.

The cooled circulation air flows in a rear direction of the base 220. Then, the cooled circulation air is heated at a high temperature while it flows along a passage defined in a rear side of the drum 200. Also, the cooled circulation air is introduced into the drum 200 from a rear direction of the drum 200 to circulate inside the dryer 10. Here, a dry duct (not shown) may be disposed on a rear surface of the cabinet 100 corresponding to a rear surface of the drum 200. An inlet of the dry duct may be connected to an exhaust hole of the circulation air. The exhaust hole of the circulation air may be connected to the rear surface of the drum 200. The heater may be disposed inside the dry duct.

The cooling air is sucked into the base 220 from a rear side of the dryer 10 by the rotation of the blow fan 223. The cooling air flows toward the heat exchanger 260 along the passage defined in the base 220 to absorb heat of the circulation air. The cooling air absorbing the heat while passing through the heat exchanger 260 is exhausted in a front or side direction of the dryer 10.

According to the above-described process, the foreign substances filtered by the filter unit 300 are automatically separated from the filter and stored in the lint case 390.

Hereinafter, a structure and operation of the filter unit 300 will be described in detail with reference to accompanying drawings.

Figure 3:
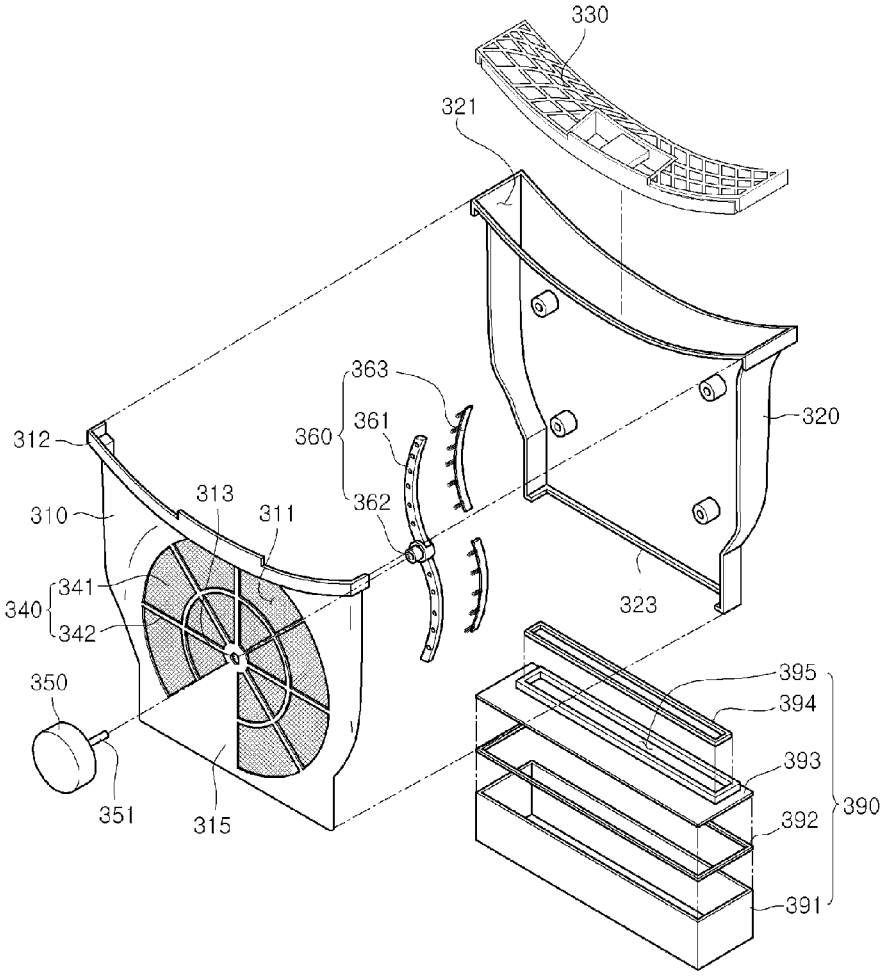
FIG. 3 is an exploded perspective view illustrating a filter unit according to a first embodiment.
Figure 4:
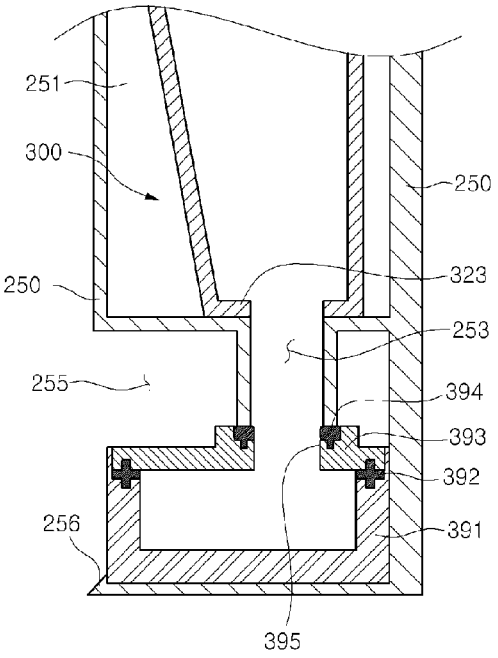
FIG. 4 is a partially side-sectional view illustrating a coupling state of the filter unit, a housing, and a lint case according to the first embodiment.
Figure 5:
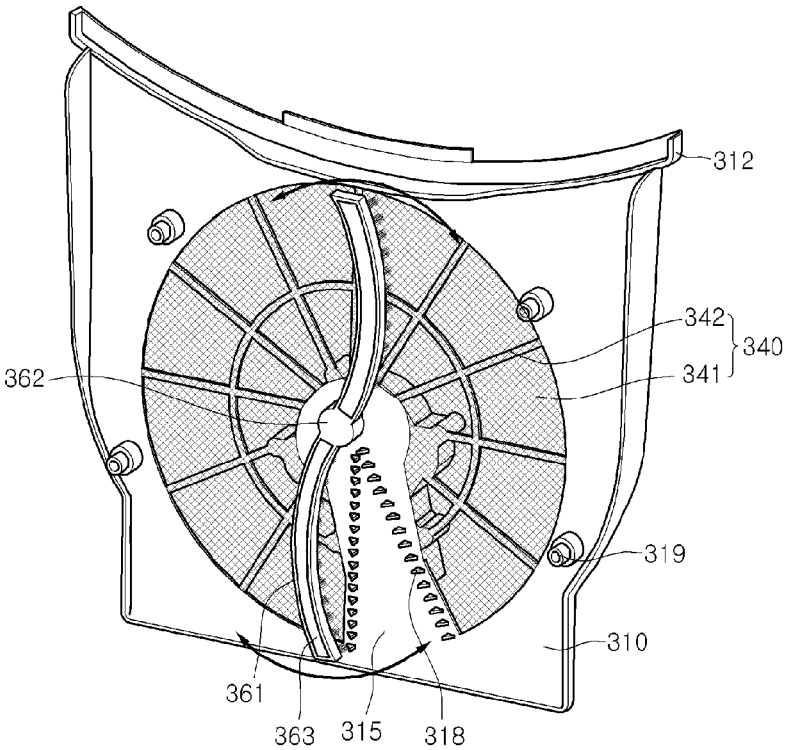
FIG. 5 is a perspective view illustrating an operation state of the filter unit according to the first embodiment.

FIG. 3 is an exploded perspective view illustrating a filter unit according to a first embodiment, FIG. 4 is a partially side-sectional view illustrating a coupling state of the filter unit, a housing, and a lint case according to the first embodiment, and FIG. 5 is a perspective view illustrating an operation state of the filter unit according to the first embodiment.

Referring to FIGS. 3 to 5, a filter unit 300 includes a front cover 310, a filter case 320, a filter part 340, and a brush unit 360. An air exhaust hole 311 is defined in the front cover 310. The filter case 320 is coupled to a rear side of the front cover 310. An air inlet 321 through which air exhausted from a drum 200 is introduced is defined in the filter case 320. The filter part 340 is disposed in the air exhaust hole 311 to filter foreign substances contained in the air exhausted from the filter unit 300. The brush unit 360 removes the foreign substances filtered by the filter part 340.

In detail, the air inlet 321 of the filter case 320 is defined in an upper surface of the filter case 320 and rounded with a curvature corresponding to that of a throwing hole 211. A grille is coupled to the air inlet 321 to prevent dry objects from being introduced into the filter unit 300.

At this time, the front cover 310 and the filter case 320 may be formed with one unitary body using injection molding or coupled to each other as separate components. Also, the air exhaust hole 311 may be changed in position. In other words, the air exhaust hole 311 may be defined in a back surface of the filter case 320.

Such a position exchange in the design can be easily made therefrom by those skilled in the art without departing form the spirit of the present disclosure.

Here, when the filter unit 300 is inserted into an air duct 215 of the drum cover 210, the front cover 310 is inserted facing a front side, and the filter case 320 is inserted facing a rear side. That is, the air exhausted from the drum 200 is introduced into the air inlet 321 through the drill 350, and the air passing through the filter part 330 is exhausted toward a front side of the filter unit 300.

At this time, to smoothly exhaust the air, the air exhaust hole 311 is spaced a predetermined distance from the air duct 215 and a front surface of a housing 250. For example, the front cover 310 may be backwardly inclined at a predetermined angle. In this case, the air inlet 321 has a shape corresponding to that of an inlet of the air duct 215 such that the air exhausted from the drum 200 does not leak to the outside of the filter unit 300. When the front cover 310 is backwardly inclined, the air exhaust hole 311 is spaced from the front surface of the housing 250 as moving toward a lower side thereof. Thus, a suction force of a blow fan 222 may be smoothly operated.

The filter part 340 is disposed in the air exhaust hole 311 of the front cover 310.

In detail, the filter part 340 includes a filter frame 342 extending from a center of the air exhaust hole 311 toward an edge portion of the air exhaust hole 311 and a filter 341 covering a space between the filter frames 342.

A blocking surface 315 configured to cover at least portion of the air exhaust hole 311 is disposed on the front cover 310. The blocking surface 315 may be a fan shape on the air exhaust hole 311. A duster portion 318 is disposed inside the blocking surface 315.

A motor 350 for a brush is coupled to a side of the front cover 310. A rotation shaft of the motor 350 for the brush passes through a rotation shaft hole 313 defined in the front cover 310. At this time, the rotation shaft hole 313 may be defined in the center of the air exhaust hole 311. Alternatively, the rotation shaft hole 313 may be defined in the filter frame 342 or the blocking surface 315.

The brush unit 360 is connected to the rotation shaft 351 of the motor 350 for the brush. The brush unit 360 is disposed in a space between the front cover 310 and the filter case 320 to separate the foreign substances attached to the filter 341.

In detail, the brush unit 360 includes a coupling part coupled to the rotation shaft 351, a brush rib 361 extending radially from the coupling part 362 up to an edge of the filter 341, and a brush 363 disposed on the brush rib 361 to separate the foreign substances from the filter 341.

At this time, a groove in which the brush 363 is inserted is defined in a back surface of the brush rib 361. That is, the brush rib 361 has the same shape as the brush 364. A plurality of holes is defined in a front surface of the brush rib 361. A fur of the brush 363 passes through the holes. The fur of the brush 363 protrudes from the front surface of the brush rib 361 by a predetermined length to contact the filter 341. Thus, to effectively separate the foreign substances attached to the filter 341, the filter 341 may be disposed within a rotation radius of the brush 363.

At this time, the brush rib 361 may have a curved line shape. In this case, since the foreign substances may be effectively gathered in a central direction of the brush unit 360 due to the curved line shape of the brush rib 361, the foreign substances may be effectively separated from the filter 341. Of cause, the brush rib 361 may have a straight-line shape.

A protrusion having a predetermined shape may be provided instead of the fur of the brush 363. In this case, the protrusion is rotated in a state where the protrusion contacts the filter 341 to rake out the foreign substances from the filter 341. Thus, the foreign substances may be easily separated from the filter 341.

A duster portion 318 for separating the foreign substances attached to the brush unit 360 is disposed inside the blocking surface 315.

The duster portion 318 protrudes in a predetermined shape. The duster portion 318 is disposed on a movement path of the brush 363 to interfere with the brush 363 when the brush 363 is rotated. Thus, the foreign substances attached to the brush 363 may interfere with the duster portion 318, and thus are separated from the brush 363. In detail, since the brush 363 includes a plurality of furs, the foreign substances may be held between the furs. Specifically, since the foreign substances mainly include fibers separated from clothes, the brush 363 may be easily held between the furs. However, since the duster portion 318 protrudes on the movement path of the brush 363, the foreign substances held between the furs of the brush 363 may be separated.

The duster portion 318 are radially arranged from a center of the blocking surface 315 up to an edge such that the foreign substances attached to the brush 363 are maximally separated. Also, the duster portion 318 may extend by a length corresponding to that of the brush rib 361.

A foreign substance discharge hole 323 is defined in a lower end of the filter case 320. The groove defined in the filter case 320 is coupled to a lower end of the front cover 310 to form the foreign substance discharge hole 323. The foreign substances separated from the filter 341 by the brush 363 or separated from the brush 363 by the duster portion 318 drop by gravity. The foreign substances are collected in a lint case 390 through the foreign substance discharge hole 323.

The lint case 390 includes a case body 391 in which a space for storing the foreign substances is defined, a first gasket 392 coupled to an upper surface of the case body 391, a case cover 392 disposed above the first gasket 392 and defining a ceiling surface of the lint case 390, and a second gasket 394 disposed corresponding to a foreign substance introduction hole defined in the case cover 393.

In detail, the case body 391 has a box shape with an opened top surface. The foreign substances discharged through the foreign substance discharge hole 323 are stored in the case body 391. The case cove 393 covers the upper opening of the case body 391 to prevent the foreign substances stored in the case body 391 from leaking to the outside. To securely prevent the foreign substances from leaking, the first gasket 392 is provided between the case cover 393 and the case body 391.

The filter unit 300 is coupled to the housing 250 to allow the foreign substance discharge hole 323 to communicate with a dropping hole 253. At this time, the dropping hole 253 may have a shape corresponding to that of the foreign substance discharge hole 323. Also, the foreign substance introduction hole 395 has a shape corresponding to that of the dropping hole 253 to allow the foreign substances separated from the filter 341 to drop into the case body 391.

At this time, the dropping hole 253 may extend downwardly from a bottom surface of the housing 250 and be connected to the case cover 393. That is, a discharge passage having a duct shape may extend from the bottom surface of the housing 250. The second gasket 394 is disposed between the foreign substance introduction hole 395 of the case cover 393 and a circumference of the dropping hole 253 to prevent the foreign substances from leaking to the outside.

The second gasket 394 may be fixed to only the case cover 393 such that the lint case 390 is easily separated.

According to the above-described components, a user may easily withdraw the lint case 390 without leaking the foreign substance to the outside.

Hereinafter, functions and operations of the filter part 340 and the brush unit 360 will be described.

The air introduced into the air inlet 321 of the filter case 320 passes through the filter part 340 and is exhausted through the air outlet 322. In this process, the foreign substances are filtered by the filter part 340 covering the air exhaust hole 311. At this time, a portion at which the foreign substances are filtered may be an inner surface of the filter 341. The air exhausted in a front direction of the filter unit 300 through the air exhaust hole 311 is spread in left and right directions along a space defined between the front surface of the housing 250 and the front surface of the filter unit 300. The air spread in the left and right directions flows toward the back surface of the housing 250 to flow into the communication hole 252 defined in the back surface of the housing 250. The air passing through the communication hole 252 flows along a passage defined within the base 220. The air heat-exchanges with indoor air and is condensed while the air passes through a heat exchanger disposed on the passage within the base 220.

The brush unit 360 is connected to the motor 350 for the brush, and thus rotated. Since the brush 363 is closely attached to the filter 341 and rotated, the foreign substances attached to the filter 341 are separated from filter 341 by the brush 363.

At this time, a portion of the foreign substances separated from the filter 341 drop by the gravity and are stored in the lint case 390. The remaining portion is hold between the furs of the brush 363.

Since the duster portion 318 is disposed on the movement path of the brush 363, the foreign substances hold between the furs of the brush 363 are separated and drop into the lint case 390.

When the foreign substances stored in the lint case 390 exceed a predetermined level, the user separates the lint case 390 from the dryer 10 and opens the case cover 393 to dump the foreign substances.

Hereinafter, a dry according to a second embodiment will be described with reference to an accompanying drawing.

Since this embodiment is equal to the first embodiment except structures of a filter unit and a brush unit, portions different from the first embodiment will mainly be described, and the same portions as the first embodiment will be denoted as the same descriptions and reference numerals.

Figure 6:
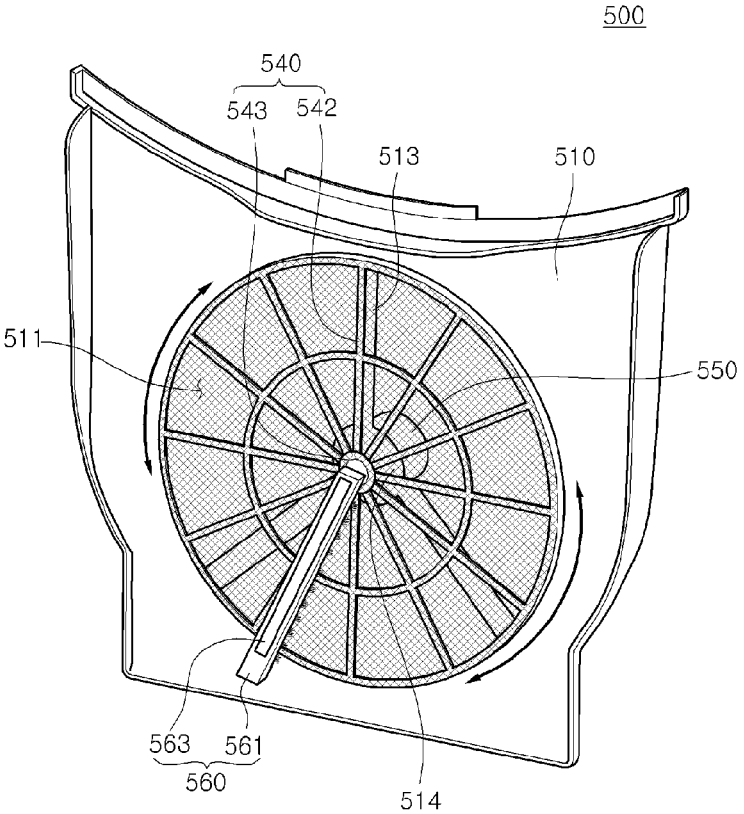
FIG. 6 is a perspective view illustrating a front cover of a dryer according to a second embodiment.

FIG. 6 is a perspective view illustrating a front cover of a dryer according to a second embodiment.

Referring to FIG. 6, in a front cover 510 of a filter unit 500 according to a second embodiment, an air exhaust hole 511 is punched into a circular shape, and a filter part 540 is disposed in the air exhaust hole 511.

In detail, the filter part 540 is connected to a motor 550 for a filter, and thus rotated by the motor 550. Thus, foreign substances are removed by a brush unit 560 closely disposed on the filter part 540.

In detail, a plurality of support ribs 513 (e.g., three support ribs spaced a distance of about 120 degrees from each other in FIG. 6) radially extending from a center of the air exhaust hole 511 is disposed on the front cover 510. The motor 550 for the filter is disposed at a point at which the support ribs 513 contact each other. The motor 510 for the filter is disposed on a front surface of the front cover 510, and a rotation shaft passes through the front cover 510 to protrude in a rear direction.

The filter part 540 includes a circular plate-shaped filter frame in which a plurality of openings is defined and a filter 541 covering the openings to filter the foreign substances. The rotation shaft of the motor for the filter is connected to a central portion of the filter frame 542 to rotate the filter part 540.

At this time, the filter frame 542 may have a diameter greater than that of the air exhaust hole 511. A circumference of the filter frame 542 is closely attached to the front cover 510. As a result, air introduced into a filter unit 300 must pass through the filter part 540, and then be exhausted to the outside.

The brush unit 560 includes a brush rib 561 disposed on a back surface of the front cover 510 and extending from the outside of the filter frame 542 up to a central portion of the filter part 540 and a brush 563 disposed on the brush rib 561.

The brush rib 561 is spaced a predetermined distance from a surface of the filter 541. Thus, the brush rib 561 does not interfere with the filter part 540 when the filter part 540 is rotated. The brush 563 passes through the brush rib 561 to contact the filter 541.

An end of the brush rib 561 is fixed to the back surface of the front cover 510 such that the brush rib 561 is not affected by the rotation of the filter part 540. In detail, the brush rib 561 has one end fixed to the outside of an edge of the air exhaust hole 511 and the other end disposed at a center of the air exhaust hole 511. As necessary, the brush rib 561 may have a length crossing a center of the filter part 540. That is, the brush rib 561 has a diameter greater than that of the air exhaust hole 511 to extend from one edge of the filter part 540 up to the other edge. Thus, when the filter part 540 is rotated, the filter 541 is brushed by the brush 563. That is, the foreign substances attached to the filter 541 are brushed by the brush 563, and thus separated from the filter 541. The separated foreign substances drop by gravity and are stored in a lint case 390.

Hereinafter, a dry according to a third embodiment will be described with reference to an accompanying drawing. Since this embodiment is equal to the first embodiment except structures of a filter unit and a brush unit, portions different from the first embodiment will mainly be described, and the same portions as the first embodiment will be denoted as the same descriptions and reference numerals.

Figure 7:
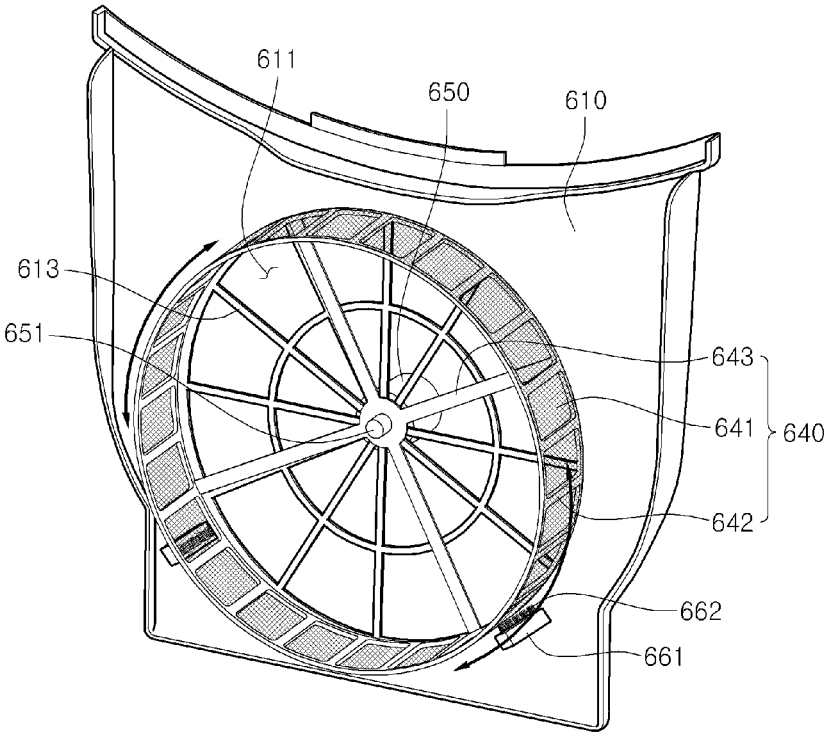
FIG. 7 is a perspective view illustrating a front cover of a dryer according to a third embodiment.

FIG. 7 is a perspective view illustrating a front cover of a dryer according to a third embodiment.

Referring to FIG. 7, in a front cover 610 of a filter unit according to a third embodiment, an air outlet 611 is punched into a circular shape. A filter part having a tubular shape along an edge of the air outlet 611 is disposed on the front cover 610. The filter part 640 may have the tubular shape as well as a polygonal shape.

The filter part 640 is connected to a motor 650 for a filter, and thus rotated by the motor 650. Thus, foreign substances are removed by a brush unit 660 closely disposed on the filter part 640. As described in the second embodiment, the motor 650 for the filter may be fixed to the air outlet 611 by a plurality of ribs 613.

In detail, the plurality of support ribs 613 radially extends on the air outlet 611. The motor 550 for the filter is disposed at a point at which the support ribs 613 contact each other. The motor 650 for the filter is disposed on a front surface of the front cover 610, and a rotation shaft passes through the front cover 610 to protrude in a rear direction.

The filter part 640 includes a filter frame 642, a connection rib 643, and a filter 641. The filter frame 642 has a tubular shape extending in the same direction as that of a rotation shaft of the motor 650 for the filter. A plurality of openings is defined in an outer circumference surface of the filter frame 642. The connection rib 643 connects the filter frame 642 to the motor 650 for the filter. The filter 641 is disposed in the openings defined in the filter frame 642 to filter foreign substances.

At this time, the connection rib 643 is disposed at a rear side of the support rib 613. Also, the connection rib 643 radially extends from a rotation center and is connected to the filter frame 642, like the support rib 613. The rotation shaft of the motor 650 for the filter passes through a center of the connection rib 643, and a fixture 651 is attached to an end of the rotation shaft passing through the connection rib 643. Thus, it may prevent the filter part 640 from being separated from the rotation shaft of the motor for the filter when the filter part 640 is rotated.

Also, a shield part having a rib shape protruding along the edge of the air outlet 611 may be disposed on the back surface of the front cover 610. The shield part is disposed inside or outside the filter frame 642 to allow air introduced into the filter unit to necessarily pass through the filter part 640.

In this case, a portion at which the foreign substances are filtered by the filter part 640 may be an outer surface of the filter 641. Thus, the brush unit 660 is disposed around the filter part 640 such that the brush unit 660 is closely attached to the outer surface of the filter part 641. The brush unit 660 includes a brush rib 661 extending from the back surface of the front cover 610 by a length corresponding to a width of the filter 641 and a brush 662 inserted into the brush rib 661 to contact the filter 641.

At this time, an end of the brush rib 661 is fixed to the back surface of the front cover 610 such that the brush rib 661 is not affected by the rotation of the filter part 640.

Thus, when the filter part 640 is rotated, the filter 641 is brushed by the brush 662. That is, the foreign substances attached to the filter 641 are brushed by the brush 662, and thus separated from the filter 641. The separated foreign substances drop by gravity and are stored in a lint case 390.

The foreign substance removing process may be performed after the drying process is finished. The foreign substance removing process may be performed whenever the drying process is finished or programmable such that it is periodically performed until the drying process reaches a preset number.

According to the dryer 10 and the filter unit 300 of the embodiments, the foreign substances adhering to the filter 341 may be automatically and easily removed to improve convenience of use. In addition, a filter cleaning cycle may increase to improve the convenience of use.

Also, it may be not required to clean the filter 341 whenever the dryer 10 is utilized. This is done because only the lint case 390 is separated to dump the foreign substances. Therefore, the convenience of use may be maximized.

Also, in case where the filter 341 is automatically cleaned, since an amount of wind passing through the inside of the drum 200 may be maintained over a predetermined level, risk of fire may be significantly reduced.

The invention claimed is:

1. A dryer comprising:

a cabinet defining an outer appearance;

a drum inside the cabinet, the drum receiving a dry object;

a drum cover supporting a front surface of the drum;

a base supporting the drum cover, the base having an air passage in which moist air passing through the drum flows; and a filter unit within the drum cover, the filter unit filtering foreign substances contained in the moist air passing through the drum, wherein the filter unit comprises:

a filter part to which the foreign substances contained in the moist air are attached; and a brush unit separating the foreign substances attached to the filter part;

a filter case in which the brush unit is received, the filter case comprising an air inlet and a foreign substance discharge part; and a front cover provided at a side of the filter case and in which an air exhaust part is defined, wherein the filter part comprises a filter frame including a plurality of ribs radially extending from a center of the air exhaust part and a filter supported by the plurality of ribs and covering the air exhaust part, and wherein the brush unit is coupled to the plurality of ribs and one of the brush unit and the filter part rotates on the center of the air exhaust part to clean the filter part.

2. The dryer according to claim 1, further comprising an air duct along which the air exhausted from the drum ascends, the air duct being defined in the drum cover.

3. The dryer according to claim 1, wherein a brush of the brush unit contacts the filter part.

4. The dryer according to claim 1, wherein the air inlet is defined in an upper side of the filter case and a foreign substance discharge part is defined in a lower side thereof, and the front cover defines a front surface of the filter case.

5. The dryer according to claim 4, wherein the filter part is rotated by the motor for the filter in a state where the filter part covers the air exhaust hole on a back surface of the front cover, and at least one end of the brush unit is fixed to the back surface of the front cover in a state where the brush unit contacts the filter part.

6. The dryer according to claim 4, wherein the filter part comprises:

a filter frame disposed around an edge of the air exhaust hole, the filter frame having a tubular shape with a predetermined width; and a filter attached to the filter frame, wherein the filter part is rotated by the motor for the filter on the back surface of the front cover.

7. The dryer according to claim 6, wherein the brush unit is fixed to the filter part in a state where the brush unit contacts the filter part on the back surface of the front cover corresponding to the edge of the air exhaust hole.

8. The dryer according to claim 1, wherein the brush unit is connected to a motor for a brush and rotated in a state where the brush unit contacts the filter part.

9. The dryer according to claim 1, wherein the filter part has a circular shape.

10. The dryer according to claim 1, wherein an end portion of the brush unit is located at a spot of circumferential surface of the filter part.

* * * * *